US005988258A

United States Patent [19]

Blejde et al.

[11] Patent Number: 5,988,258

[45] Date of Patent: Nov. 23, 1999

[54] CASTING METAL STRIP

[75] Inventors: Walter Blejde; Christian Barlow, both of Balgownie, Australia

[73] Assignees: Ishikawajima-Harima Heavy Industries Company Limited, Tokyo, Japan; BHP Steel (JLA) Pty Ltd, Victoria, Austria

[21] Appl. No.: 09/034,239

[22] Filed: Mar. 4, 1998

[30] Foreign Application Priority Data

Mar. 27, 1997 [AU] Australia ..... PO5916

[51] Int. Cl.[6] ..... B22D 11/06; B22D 11/18; B22D 11/20

[52] U.S. Cl. ..... 164/453; 164/454; 164/480; 164/428; 164/449.1

[58] Field of Search ..... 164/480, 428, 164/453, 454, 449.1, 450.1, 450.2, 450.4, 458.5, 413

[56] References Cited

U.S. PATENT DOCUMENTS 4,774,999 10/1988 Kraus ..... 164/454

FOREIGN PATENT DOCUMENTS 1-154850 6/1989 Japan ..... 164/480
4-167950 6/1992 Japan ..... 164/480

*Primary Examiner*—Kuang Y. Lin
*Attorney, Agent, or Firm*—Kerkam, Stowell, Kondracki & Clarke, P.C.; John C. Kerins

[57] ABSTRACT

Casting metal strip by delivering molten metal to a casting pool (81) supported on a pair of parallel casting rolls (16) and passing metal downwardly between the rolls to produce solidified strip (20). Flow of metal to the casting pool (81) is controlled by an input flow control valve (47). At start of casting when pool (81) is being filled speed of rolls (16) is varied in response to variations between actual instantaneous pool level and predicted level until pool approaches desired operational level. Thereafter any variations between instantaneous roll speed and desired operational roll speed are caused to adjust valve (47) to being pool level and roll speed to desired operational valves.

8 Claims, 7 Drawing Sheets

CASTING METAL STRIP

BACKGROUND TO THE INVENTION

This invention relates to the casting of metal strip. It has particular but not exclusive application to the casting of ferrous metal strip.

It is known to cast metal strip by continuous casting in a twin roll caster. Molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip so as to direct it into the nip between the rolls, so forming a casting pool of molten metal supported on the casting surfaces of the rolls immediately above the nip. This casting pool may be confined between end closure side plates or dams held in sliding engagement with the ends of the rolls.

Although twin roll casting has been applied with some success to non-ferrous metals which solidify rapidly on cooling, there have been problems in applying the technique to the casting of ferrous metals which have high solidification temperatures and a tendancy to produce defects caused by uneven solidification at the chilled casting surfaces of the rolls. When casting ferrous strip it is particularly important to maintain a required metal flow distribution across the width of the casting rolls and defects can occur due to minor flow fluctuations from the required metal flow distribution. It is therefore important to achieve steady state casting conditions with very accurate control over the casting pool level and the casting speed. It has previously been proposed to continuously monitor the casting pool level and to control the flow of metal to the delivery nozzle by operation of a flow control valve in response to the pool level measurements in order to maintain an optimum pool level. An arrangement of this kind is described in our Australian patent 642049 which fully describes the construction and operation of an appropriate metal flow control valve.

Controlling the flow of metal to the delivery nozzle in response to pool level measurements enables accurate control of the pool level during steady state casting conditions. However this form of control is insufficient to deal with the problem of establishing even cooling and solidification on initial start-up when the casting pool is being established and filled to an operational level. It is essential to achieve even cooling and solidification very rapidly in order to allow continuous casting to be initiated before steady state conditions can be established to allow casting to proceed under optimum conditions. To meet these requirements the casting pool must be filled very quickly but in a controlled manner without overshooting a controlled rate of fill so as to enable the metal to solidify and form a coherent strip under start-up conditions.

One possible start-up technique is simply to operate the flow control valve in a predetermined flow control sequence designed to produce a predicted rise in pool level through the start-up period. Specifically, the control valve may be moved in incremental steps from an open condition toward a more restricted condition so that the rate of pool level increase reduces as the level approaches the required operational level. However, the condition of the rolls and the casting pool can change very rapidly during start-up. These fluctuations cannot be accurately forecast and the rising pool level will invariably tend to vary from the predicted and desired start-up pattern. Because of the time delay between changes in the setting of the control valve and consequent effects in the casting pool, it is impossible to control such variation by movement of the control valve in response to actual pool level measurements. The present invention addresses this problem by providing a two-stage start-up procedure. In the first stage, the initial start-up phase, the rise of the pool level during filling of the pool is controlled by varying the rotational speed of the casting rolls in response to instantaneous pool level measurements. Variation of the roll speed variations can produce a very rapid change of pool level and it has been found that it is possible by controlling the speed of the rolls in combination with operation of the control valve in a predetermined sequence to accurately control the rise of the pool level to conform with a required pattern. This initial start-up phase permits the roll speed to depart from the desired optimum speed for steady state casting. In the second stage, the transition phase, any variation of the roll speed from the desired optimum speed is used to cause adjustment of the control valve to enable the roll speed to be brought within a desired speed range. Once within the desired pool level and optimum speed range the invention provides for a steady-state phase of control in which pool level variations are adjusted directly by the control valve and speed is controlled in response to the instantaneous pool level.

SUMMARY OF THE INVENTION

According to the invention there is provided a method of casting metal strip comprising introducing molten metal between a pair of chilled casting rolls forming a nip between them via a metal delivery system having a metal input flow control valve to form a casting pool of molten metal supported on the rolls and confined at the ends of the nip by pool confining end closures, and rotating the rolls so as to cast a solidified strip delivered downwardly from the nip; wherein at the start of metal casting when the casting pool is being filled to approach a desired operational level the speed of the casting rolls is varied in response to variations between actual instantaneous pool level measurements and predicted instantaneous pool level values to control the rise of the pool level until the pool level approaches the desired operational level, whereafter any variations between instantaneous roll speed measurements and a desired operational roll speed value are caused to adjust the input flow control valve to control the inflow of molten metal to the casting pool to enable the instantaneous pool level and instantaneous roll speed measurements to be brought within predetermined tolerance ranges about the desired operational pool level and roll speed values.

Preferably thereafter the flow control valve is adjusted in accordance with instantaneous pool level measurements and the roll speed is simultaneously varied in accordance with those measurements to maintain the pool level and roll speed within said predetermined ranges to maintain essentially steady state casting conditions.

The invention further provides apparatus for casting metal strip comprising a pair of parallel casting rolls forming a nip between them;

a metal delivery system for delivering molten metal into the nip to form a casting pool of molten metal supported above the nip, which delivery system includes a flow control valve adjustable to control the flow of metal to the casting pool;

a pair of pool confining end closures disposed one at each end of the pair of casting rolls;

roll drive means to rotate the rolls in opposite directions to deliver a cast strip downwardly from the nip;

a pool level sensor to monitor the level of the casting pool and produce pool level measurement signals;

a roll speed sensor to monitor the speed of the casting rolls and produce roll speed measurement signals; and a process controller to receive said pool level and roll speed measurement signals and to control operation of the flow control valve and casting roll drive means in response to those signals, wherein the process controller is operative at the start of metal casting when the casting pool is being filled to a desired operational level to vary the speed of the rolls in response to variations between the actual instantaneous pool level measurements and predicted instantaneous pool level values to control rising of the pool level until the pool level approaches the operational level.

Preferably the process controller is thereafter operative to calculate variations between instantaneous roll speed measurements and an optimum roll speed value and to adjust both the flow control valve and the roll speed means in accordance with those calculations to bring both the pool level and roll speed measurements within predetermined tolerance ranges about the desired operational pool level and roll speed values.

BRIEF DESCRIPTION OF THE DRAWINGS

In order that the invention may be more fully explained, one particular embodiment will be described in detail with reference to the accompanying drawings in which.

Figure 1:
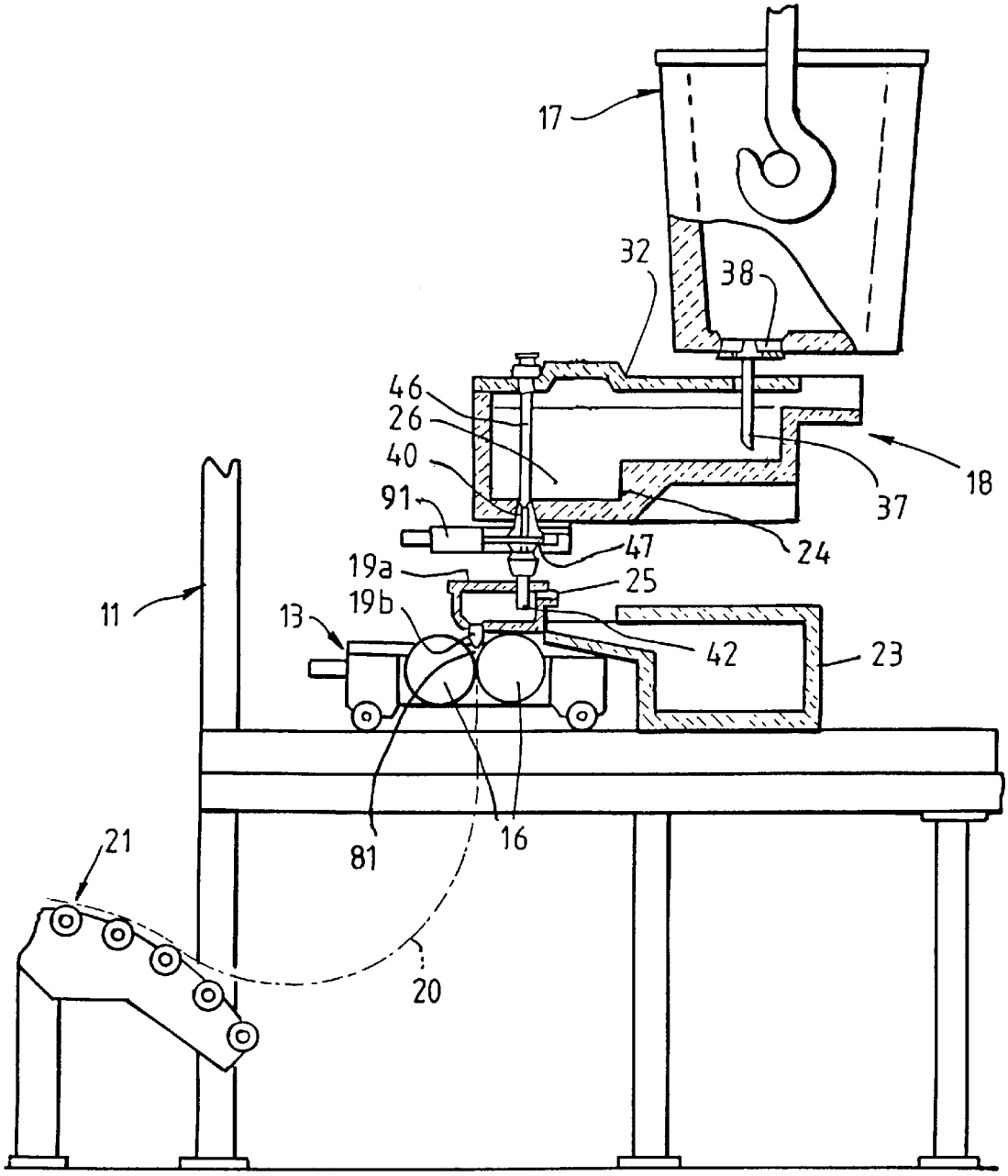
FIG. 1 illustrates a continuous strip caster suitable for operation in accordance with the present invention.

The illustrated caster comprises a main machine frame, generally identified by the numeral 11, which stands up from the factory floor 12. Frame 11 supports a casting roll carriage 13 which is horizontally movable between an assembly station and a casting station. Carriage 13 carries a pair of parallel casting rolls 16 which form a nip in which a casting pool of molten metal is formed and retained between two side plates or dams (not shown) held in sliding engagement with the ends of the rolls.

Molten metal is supplied during a casting operation from a ladle 17 via a tundish 18, delivery distributor 19*a* and nozzle 19*b* into the casting pool. Before assembly above the carriage 13, tundish 18, distributor 19*a*, nozzle 19*b* and the side plates are all preheated to temperatures in excess of 1000° C. in appropriate preheat furnaces (not shown). The manner in which these components may be preheated and moved into assembly above the carriage 13 is more fully disclosed in U.S. Pat. No. 5,184,668.

Casting rolls 16 are water cooled so that molten metal from the casting pool solidifies as shells on the moving roll surfaces and the shells are brought together at the nip between them to produce a solidified strip product 20 at the roll outlet. This product is fed to a run out table 21 and subsequently to a standard coiler. A receptacle 23 is mounted on the machine frame adjacent the casting station and molten metal can be diverted into this receptacle via an overflow spout 25 on the distributor 19*a* if there is a severe malfunction during a casting operation.

Figure 2:
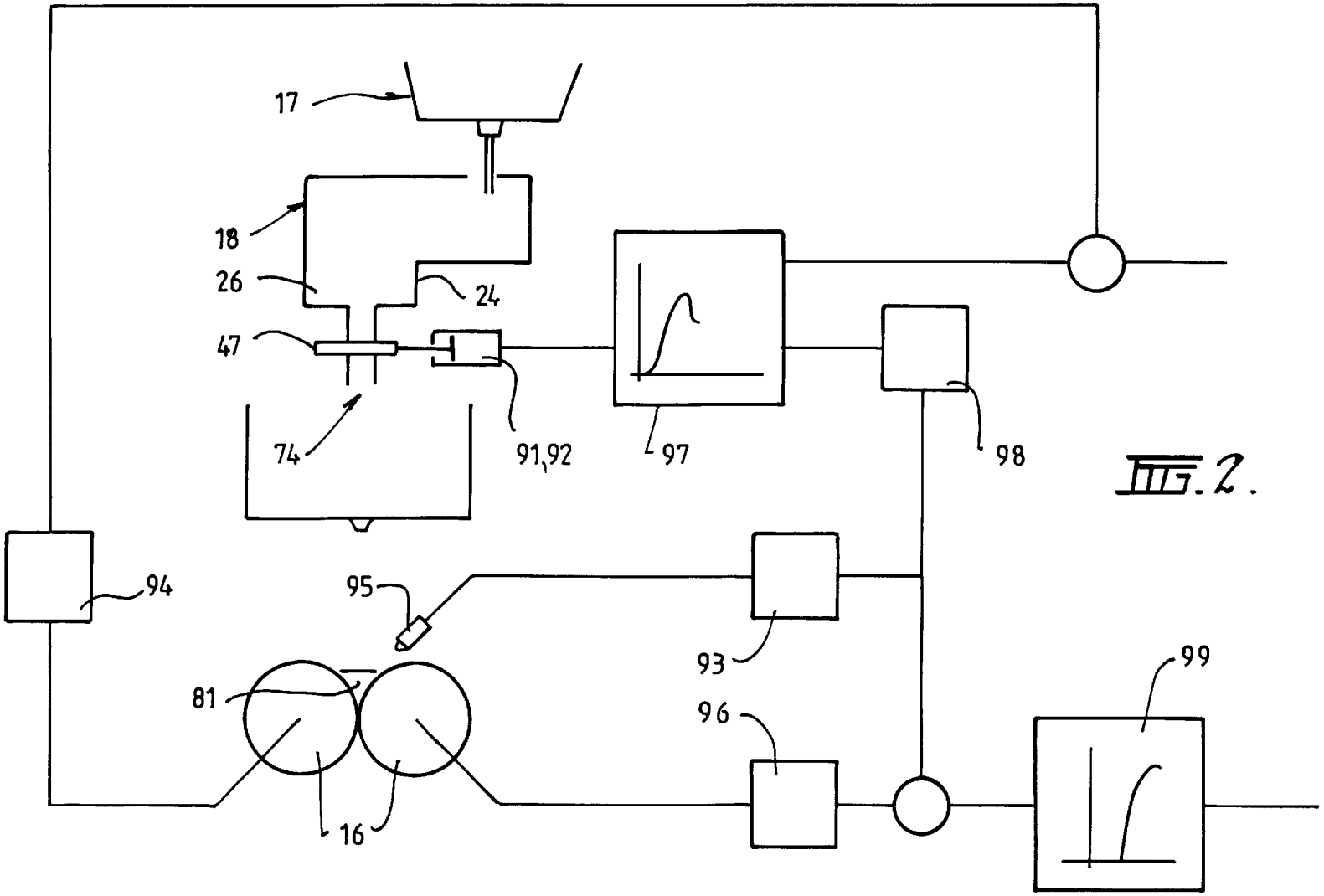
FIG. 2 diagrammatically illustrates a circuitry of a process controller for controlling the operation of the caster during a two-stage start-up procedure.

Tundish 18 is fitted with a lid 32 and its floor is stepped at 24 so as to form a recess or well 26 in the bottom of the tundish at its left-hand and as seen in FIG. 2. Molten metal is introduced into the right-hand end of the tundish from the ladle 17 via an outlet nozzle 37 and slide gate valve 38. At the bottom of well 26, there is an outlet 40 in the floor of the tundish to allow molten metal to flow from the tundish via an outlet nozzle 42 to the delivery distributor 19*a* and the nozzle 19*b*. The tundish 18 is fitted with a stopper rod 46 and slide gate valve 47 to selectively open and close the outlet 40 and effectively control the flow of metal through the outlet.

In operation of the illustrated apparatus, molten metal delivered from delivery nozzle 19*b* forms a pool 81 above the nip between the rollers, this pool being confined at the ends of the rollers by side closure plates which are held against stepped ends of the rollers by actuation of a pair of hydraulic cylinder units. The upper surface of pool 81, generally referred to as the "meniscus level" rises above the lower end of the delivery nozzle. Accordingly, the lower end of the delivery nozzle is immersed within the casting pool and the nozzle outlet passage extends below the surface of the pool or meniscus level. The flow of metal is also such as to produce a head or pool of molten metal within the lower part of the delivery nozzle to a height above the meniscus level 82.

The gate valve 47 enables accurate regulation of the flow from the tundish from complete shut off to full flow conditions and so allows accurate control of the metal flow distribution to the nip between the casting rollers.

Figure 3:
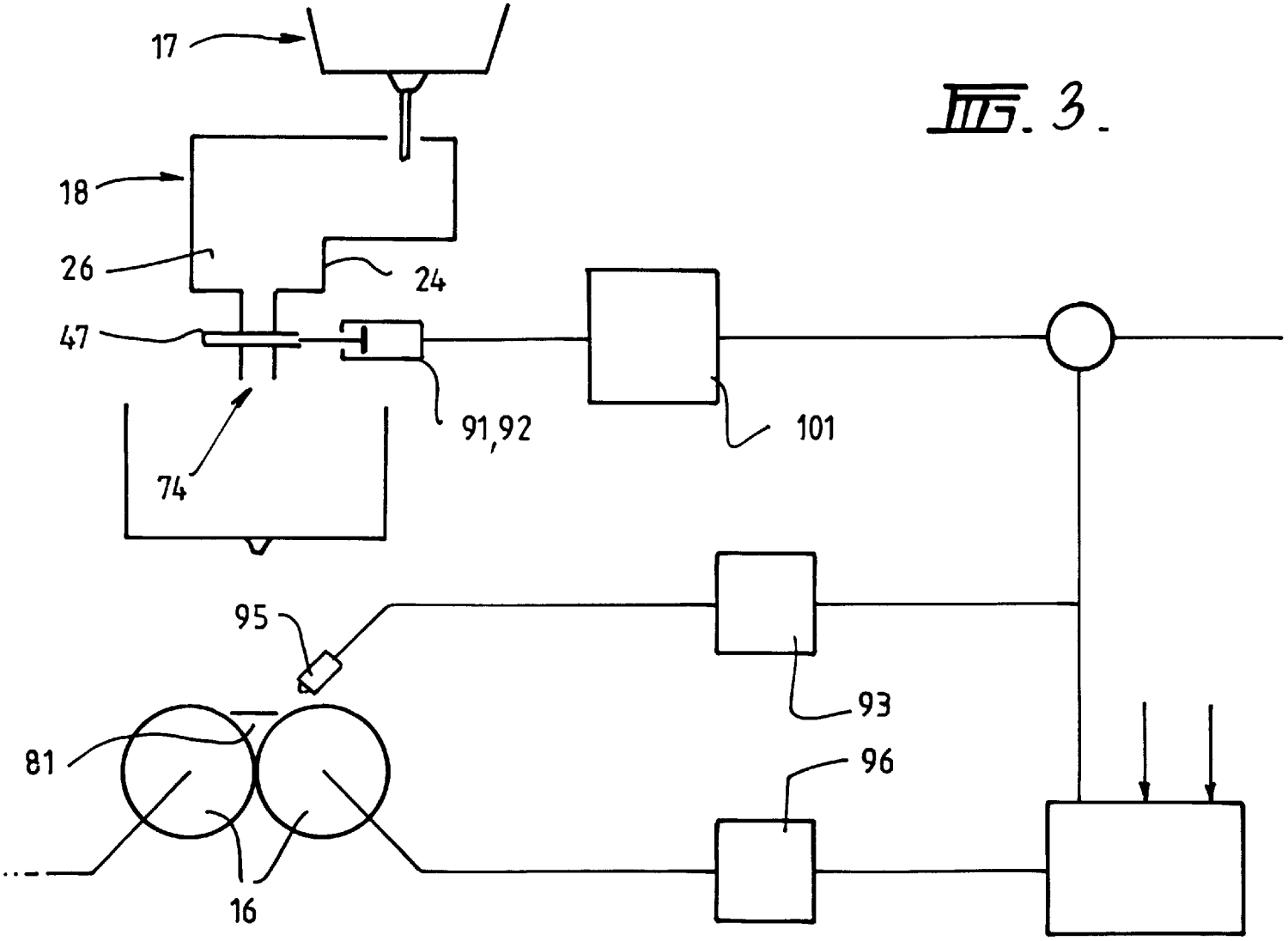
FIG. 3 illustrates further control circuitry of the controller for controlling operation of the caster during steady state casting following the start-up procedure.
Figure 4:
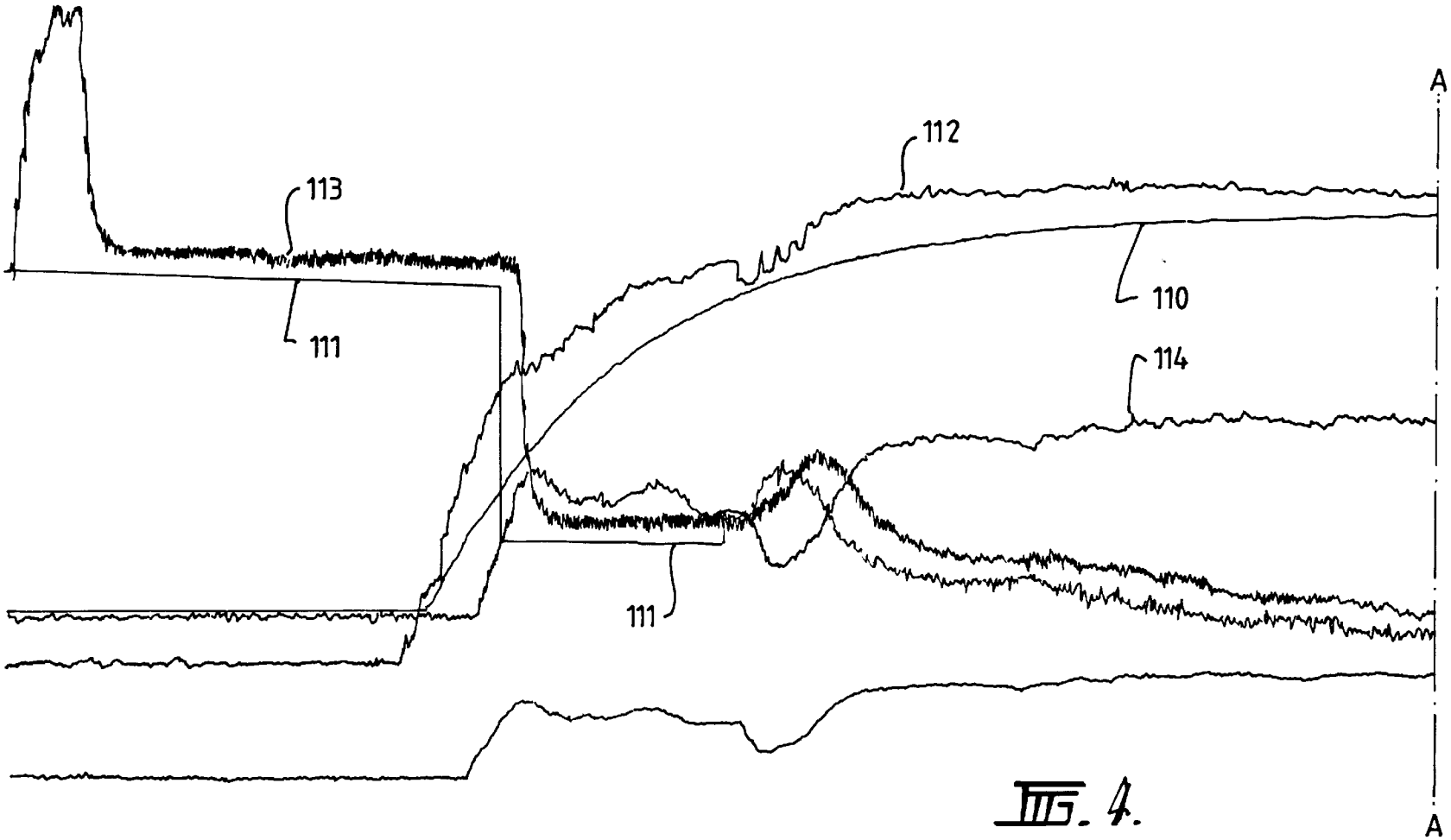
FIGS. 4, 5, 6 and 7 join on the lines AA, BB and CC to show a plot of reference values and actual measurements of pool level, roll speed and control valve positions during the start-up procedure and subsequent steady state phase during an actual cast on a strip caster operated in accordance with the present invention.
Figure 5:
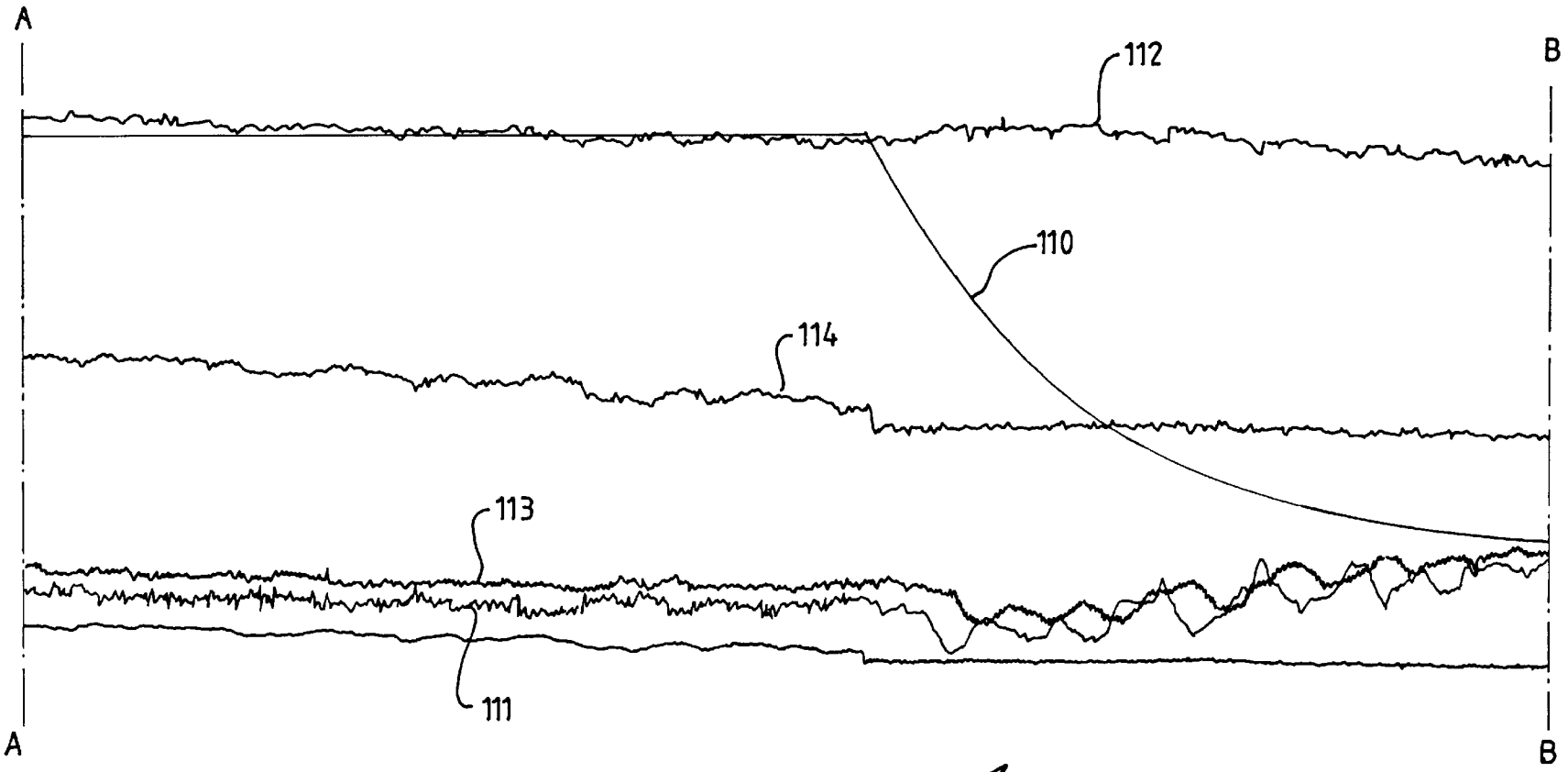
Figure 6:
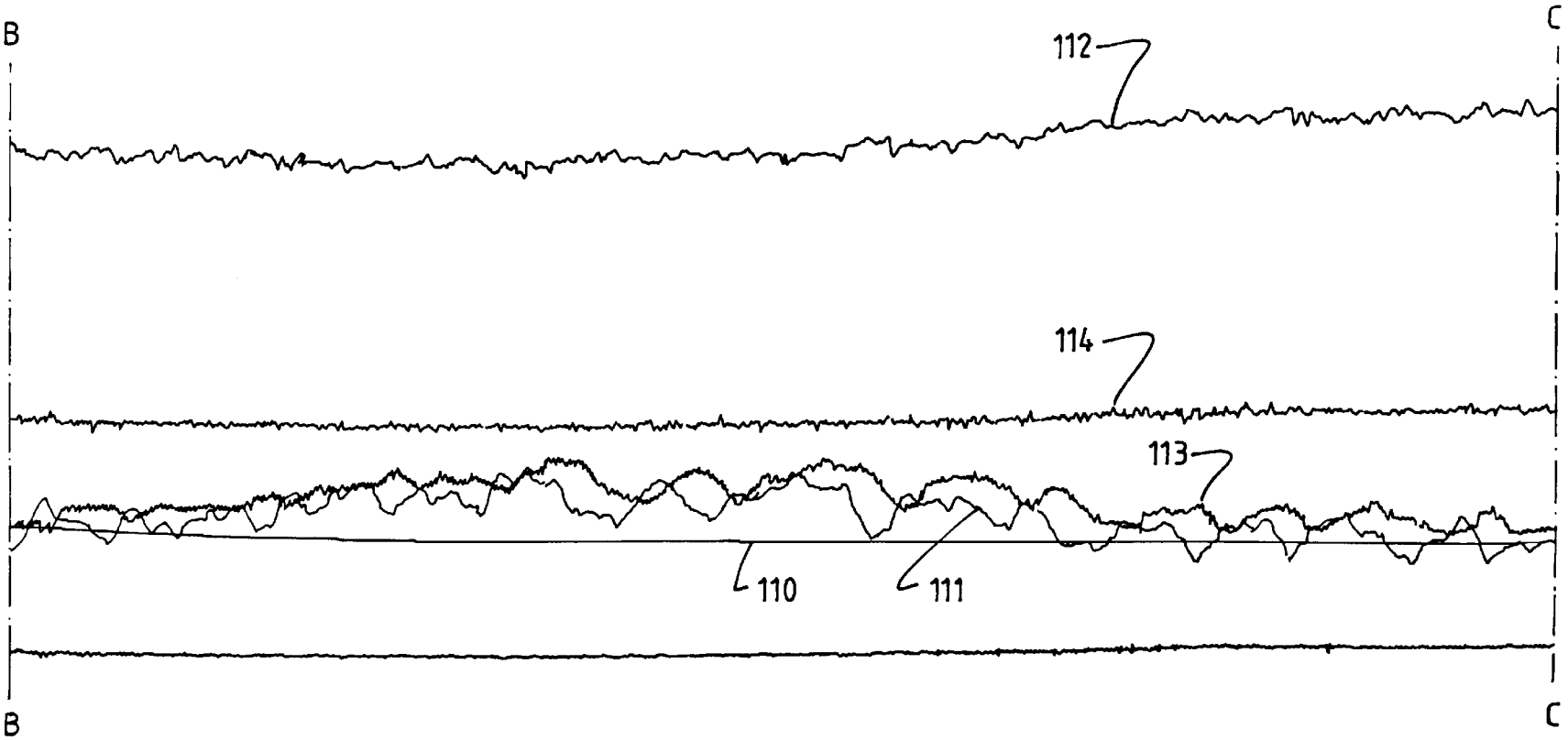
Figure 7:
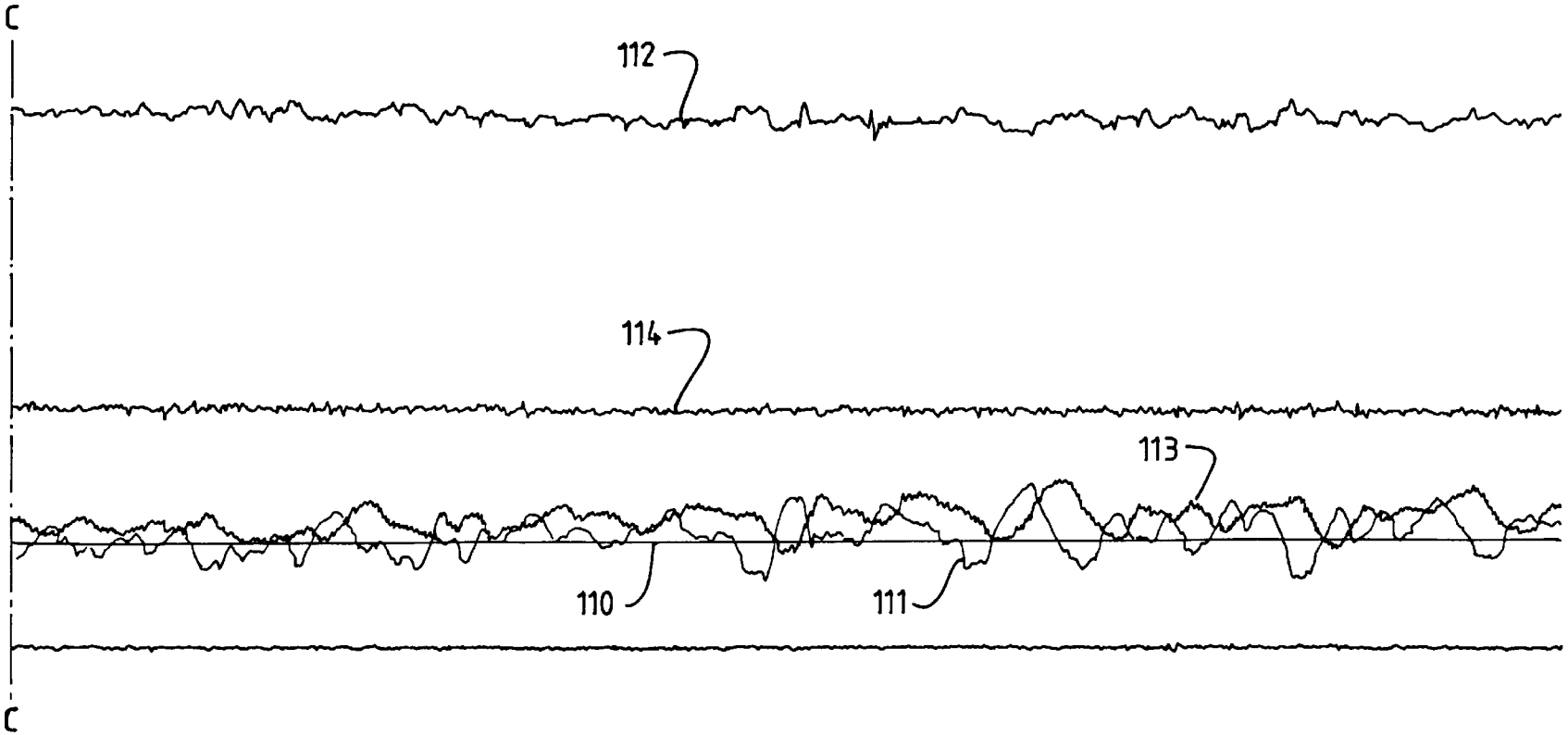

The actuator cylinder 91 of gate valve 47 is linked by servo controllers to an automatic process controller 100 incorporating control circuits as illustrated diagrammatically in FIGS. 2 and 3. FIG. 2 illustrates the control circuitry which is effective during the start-up procedure when the casting pool is being filled toward its optimum operational level and FIG. 3 illustrates the circuitry which is subsequently effective on establishment of steady state casting conditions.

With reference to FIG. 2, in the initial start-up phase, process controller 100 receives inputs from a pool level sensor system 93 and a roll speed sensor system 94. Pool level sensor system 93 may comprise a video camera 95 which continuously monitors the level of the pool 81 and the roll speed sensor system 94 may comprise any convenient speed sensor installed on the rolls or roll drive system.

The process controller 100 is linked to the drive system for the rolls through a speed control device 96 so as to positively control the speed of the rolls throughout a casting operation. The process controller 100 includes a start-up controller 97 which is linked to the actuator cylinder 91 of the gate valve 47. The process controller 100 also includes a trigger transfer device 98 and a data input device 99. The start-up controller 97 operates only when instructed by the transfer device 98.

To initiate start-up a desired pool fill reference pattern is inputted to device 99 of the process controller 100 to initiate start-up. This causes the transfer device 98 to activate start-up controller 97 which calculates a sequence of movements for the gate valve 47 and then introduces metal to rolls 16. The pool fill now commences. The actual pool level is monitored continuously by the pool level sensor 93. The rising actual instantaneous pool level is compared with the desired pool fill reference pattern. Differences between the instantaneous pool level measurements and the pool fill reference pattern are used to derive control signals to operate the speed controller 96 so as to vary the speed of the rolls 16 to cause the pool level to follow the desired pool fill reference pattern.

FIGS. 4 to 7 plot actual results achieved during operation of a strip caster in accordance with the invention during the initial start-up, transition, and subsequent steady state phases. The start-up and transition phases are recorded in FIGS. 4 and 5. In these figures, the desired pool fill reference pattern is indicated by the line 110 and the predetermined reference pattern of movement for the gate valve 47 is indicated by the line 111. Line 112 shows actual pool level measurements and line 113 actual positions of the gate valve 47 during the initial start-up phase and transition phase. Line 114 is a plot of the actual roll speed.

It will be seen that by controlling the roll speed in response to variations of pool level from the reference levels 110 the build-up in the pool level has been controlled to closely follow the desired reference pattern.

When the pool level has reached a predetermined value the transition phase is initiated and transfer device 98 in the process controller 100 then conditions the start-up controller 97 to operate the gate valve 47 in accordance with a calculation of the difference between the actual roll speed and a pre-set desired operating roll speed for steady state conditions, which desired operating roll speed is selected to achieve a predetermined contact time based on desired strip thickness, and the roll speed is adjusted and the gate valve 47 is opened or closed as required until both the roll speed and the pool level have been brought within predetermined tolerance ranges about the desired operational levels. This stage of the operation is seen in the transition from the levels in FIG. 5 to those in FIG. 6.

At this stage the process controller 100 switches to a steady state control phase in which it operates in the manner illustrated in FIG. 3.

With reference to FIG. 3, the process controller 100 includes a steady state pool controller 101 which is linked to and controls the gate valve 47. The process controller 101 also includes a data input device 103 which receives desired casting parameters, such as strip thickness and pool height, and calculates a required contact time and a roll speed to achieve the desired casting parameters. The steady state pool controller 101 operates gate valve 47 directly in response to pool level variation from reference and controls the roll speed to achieve the desired contact time. In this operation the steady state pool controller 101 and the speed control device 96 both operate in response to pool level measurements from the level sensor 93 to maintain the pool level and the speed within predetermined tolerance ranges about the optimum values determined by the initial settings of the predetermined pool level and strip thickness inputted via device 103 in the manner seen in the plots in FIGS. 6 and 7.

Appropriate filters are included in the pool level and speed sensor systems to filter out very short term fluctuations which can occur in any casting operation. The filtering systems take a band of measurements over successive time zones of the order of 20 microseconds and averages the instantaneous values over several successive bands.

We claim:

1. A method of casting strip comprising passing molten metal through a flow control valve and into a nip between a pair of parallel chilled casting rolls to form a casting pool supported on the rolls;

confining the casting pool at the ends of the nip by pool confining end closures;

rotating the rolls so as to cast a solidified strip delivered downwardly from the nip;

throughout a first time period, during the start of metal casting when the casting pool is being filled to approach a desired operational level, varying an instantaneous speed of the casting rolls in response to variations between actual instantaneous pool level measurements and predicted instantaneous pool level values, to control the rise of the pool level until the pool level approaches the desired operational level; and throughout a succeeding time period comparing instantaneous roll speed measurements with a desired operational roll speed value and causing any variations between the instantaneous roll speed measurements and the desired operational roll speed value to adjust said flow control valve to control the inflow of molten metal to the casting pool to enable the instantaneous pool level and instantaneous roll speed measurements to be brought within predetermined tolerance ranges about the desired operational pool level and roll speed values.

2. A method as claimed in claim 1, further comprising the step of actuating said flow control valve during said first time period in a predetermined control sequence which determines said predicted instantaneous pool level values such that said predicted instantaneous pool level values follow a specific pool fill profile.

3. A method as claimed in claim 2, wherein the predicted instantaneous pool level values increase progressively toward the desired operational pool level.

4. A method as claimed in claim 1, further comprising the step of, after expiry of said first and said succeeding time periods, actuating the flow control valve in response to instantaneous pool level measurements and varying the roll speed simultaneously in response to those same measurements to maintain the pool level and roll speed within said predetermined tolerance ranges whereby to maintain essentially steady state casting conditions.

5. Apparatus for casting metal strip comprising:

a pair of parallel casting rolls forming a nip between them;

a metal delivery system for delivering molten metal into the nip to form a casting pool of molten metal supported above the nip, which delivery system includes a flow control valve adjustable to control the flow of metal to the casting pool;

a pair of pool confining end closures disposed one at each end of the pair of casting rolls;

roll drive means for rotating the rolls in opposite directions to deliver a cast strip downwardly from the nip;

a pool level sensor to monitor the level of the casting pool and produce pool level measurement signals;

a roll speed sensor to monitor the speed of the casting rolls and produce roll speed measurement signals; and a process controlling means to receive said pool level and roll speed measurement signals and to control operation of the flow control valve and casting roll drive means in response to those signals, wherein the process controlling means is so constructed and arranged to operate, throughout a first time period at the start of metal casting when the casting pool is being filled, to approach a desired operational level, to vary the instantaneous speed of the casting rolls in response to variations between actual instantaneous pool level measurements and predicted instantaneous pool level values to control the rise of the pool level until the pool level approaches the desired operational level and to operate, during a succeeding time period, to compare instantaneous roll speed measurements with a desired operational roll speed value and to cause any variations between the instantaneous roll speed measurements and the desired operational rolls speed value to adjust said flow control valve to control the inflow of molten metal to the casting pool to enable the instantaneous pool level and instantaneous roll speed measurements to be brought within predetermined tolerance ranges about the desired operational pool level and roll speed values.

6. Apparatus as claimed in claim 5, wherein the process controlling means is preconditionable to actuate the flow control valve in a predetermined control sequence which determines said predicted instantaneous pool level values such that said predicted instantaneous pool level values follow a specific pool fill profile.

7. Apparatus as claimed in claim 6, wherein the process controlling means is preconditionable to operate such that said predicted instantaneous pool level values increase progressively toward the desired operational pool level.

8. Apparatus as claimed in claim 5, wherein the process controlling means is further so constructed and arranged to operate after expiry of said first and succeeding time periods to actuate the flow control valve in response to instantaneous pool level measurements and to vary the roll speed simultaneously in response to those same measurements to maintain the pool level and roll speed within said predetermined tolerance ranges about the desired operational pool level and roll speed values.

* * * * *